US007165741B2

(12) United States Patent
Takagi et al.

(10) Patent No.: US 7,165,741 B2
(45) Date of Patent: Jan. 23, 2007

(54) CASSETTE FOR ROLLED RECORDING MEDIUM AND IMAGE FORMING APPARATUS

(75) Inventors: Osamu Takagi, Nagoya (JP); Susumu Kuzuya, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 97 days.

(21) Appl. No.: 10/786,140

(22) Filed: Feb. 26, 2004

(65) Prior Publication Data

US 2004/0173706 A1 Sep. 9, 2004

(30) Foreign Application Priority Data

Mar. 5, 2003 (JP) ..... 2003-058106
Mar. 5, 2003 (JP) ..... 2003-058123

(51) Int. Cl.
*B65H 20/02* (2006.01)

(52) U.S. Cl. ..... 242/564.4

(58) Field of Classification Search ..... 242/348, 242/348.3, 348.4, 564, 564.1, 564.4, 588.5, 242/160.1, 160.4
See application file for complete search history.

(56) References Cited

U.S. PATENT DOCUMENTS

| | | | | |
|---|---|---|---|---|
| 4,690,344 | A * | 9/1987 | Yokota | 242/564.1 |
| 4,928,897 | A * | 5/1990 | Satou et al. | 242/564.4 |
| 5,362,008 | A * | 11/1994 | Nagel et al. | 242/564.4 |
| 5,553,809 | A * | 9/1996 | Oku | 242/564.4 |
| 5,758,840 | A * | 6/1998 | Murakami | 242/564.4 |
| 5,771,769 | A * | 6/1998 | Robertson | |
| 5,911,380 | A * | 6/1999 | Shiba | 242/348 |
| 6,089,487 | A * | 7/2000 | Imai et al. | 242/348.4 |
| 6,172,737 | B1 * | 1/2001 | Yamada | |
| 6,196,493 | B1 * | 3/2001 | Tanaka | 242/564.4 |
| 6,244,530 | B1 * | 6/2001 | Imai et al. | 242/160.4 |
| 6,357,686 | B1 * | 3/2002 | Imai et al. | 242/348.4 |
| 6,412,726 | B1 * | 7/2002 | Inana et al. | 242/348.4 |
| 6,641,072 | B1 * | 11/2003 | Imai et al. | 242/348.4 |

FOREIGN PATENT DOCUMENTS

| | | |
|---|---|---|
| EP | 0 914 960 A2 | 5/1999 |
| JP | 48-56145 | 8/1973 |
| JP | A-48-56145 | 8/1973 |
| JP | U-51-2946 | 6/1974 |
| JP | U-53-51242 | 10/1976 |
| JP | A-54-21733 | 2/1979 |
| JP | A-5-229194 | 9/1993 |
| JP | U 5-86541 | 11/1993 |
| JP | A 6-171171 | 6/1994 |
| JP | U-6-54053 | 7/1994 |
| JP | A-9-278243 | 10/1997 |
| JP | A 10-157886 | 6/1998 |
| JP | A-10-279151 | 10/1998 |
| JP | A 2001-130793 | 5/2001 |
| JP | A 2002-234645 | 8/2002 |

* cited by examiner

*Primary Examiner*—William A. Rivera
(74) *Attorney, Agent, or Firm*—Oliff & Berridge, PLC

(57) ABSTRACT

When a sheet cassette having a roll of paper is attached to a body of a printer, a leading edge of a sheet is always brought to position at a certain position. When the sheet cassette is not attached to the printer body, a stopper, provided near an end of a lever, protrudes to the outside from an opening, so that the leading edge of the sheet, which has passed between a pair of correcting rollers, abuts against the stopper. When the sheet cassette is attached to the printer body, the lever rotates in a clockwise direction, so that the stopper retracts in the opening.

19 Claims, 6 Drawing Sheets

CASSETTE FOR ROLLED RECORDING MEDIUM AND IMAGE FORMING APPARATUS

BACKGROUND OF THE INVENTION

1. Field of Invention

The invention relates to a recording medium cassette and an image forming apparatus with the recording medium cassette.

2. Description of Related Art

The exists, as an image forming apparatus that forms an image onto a recording medium, an ink-jet recording apparatus, for example. The ink-jet recording apparatus records a predetermined image onto a recording medium supplied thereinto by ejecting ink droplets from nozzles. Generally, cut sheets are used in the ink-jet recording apparatus as the recording mediums. Since the application of the ink-jet recording apparatus has been recently widened, there are a number of requests to perform recording onto not only cut sheets but also a long length of recording medium (a roll of paper).

There are two types of printers that record an image onto a sheet drawn from a roll of paper. One type of printer includes a roll of paper that is directly attached to a body of the printer. The second type of printer includes a cassette having a roll of paper that is attached to a body of the printer. In the former printer, it is burdensome to attach the roll of paper to the printer body because the roll of paper is directly and rotatably attached to the body while a leading edge of the roll of paper, which is supplied into a sheet supply port for conveying the sheet to a printing position, is prevented from coming out therefrom when attaching the roll of paper to the body.

Japanese Laid-Open Utility Model Publication No. 5-86541 (pages 6–9 and figures 1–3) discloses a structure for accommodating a roll of paper in a printer of the latter type, wherein a detachable rolled sheet holder (cassette) is attached to an equipment (printer) body. The printer body includes a printing portion having a pair of receiving rollers and a holder mounting portion to which the rolled sheet holder is attached. In order to place a roll of paper into the rolled sheet holder, first, the roll of paper is attached to the rolled sheet holder so as to be rotatably supported. A leading edge of the rolled sheet is then pinched between a first roller shaft and a second roller shaft which is urged toward the first roller shaft by a spring. Then, when the rolled sheet holder, having the roll of paper, is slidingly attached to the holder mounting portion of the printer body, a guide roller, provided at an end of the first roller shaft, rotates the sheet by a roller guide portion provided in the printer body. Thus, the leading edge of the rolled sheet, pinched between the first and second roller shafts, reaches the pair of receiving rollers provided in the printing portion. As described above, the leading edge of the rolled sheet can be easily taken into the printing portion of the printer body so that an operation of attaching the roll of paper becomes easy.

In the common ink-jet recording apparatus using a roll of paper, a leading edge of the rolled sheet is positioned at a start of a sheet conveying path while the roll of paper is disposed at an upstream position in a sheet conveying direction. Then, the sheet drawn from the roll of paper is conveyed to a printing position to perform a printing operation. However, because a sheet with a long length is wound into a roll, the sheet is curled. Especially, because a leading edge portion of the sheet is free from restraint, the leading edge portion tends to curve when the sheet is conveyed.

Thus, when an image is recorded onto the sheet drawn from the roll of paper, ink droplet landing accuracy degrades due to the curl of the sheet, thereby deteriorating an image printing quality.

Japanese Laid-Open Patent Publication No. 10-279151 (pages 2–3 and figures 2, 3) discloses an ink-jet recording apparatus that resolves the above problems. In this ink-jet recording apparatus, first, a leading edge of a sheet drawn from a roll of paper loaded in a rolled sheet holder is pinched between auxiliary sheet supply rollers. Then, the sheet is pinched between a pair of correcting rollers. When the auxiliary sheet supply rollers rotate in this state, a curl caused on the rolled sheet is corrected by passing between the correcting rollers. Accordingly, the deterioration of the printing quality due to the curl of the rolled sheet can be restricted.

Furthermore, in the rolled sheet accommodating structure of the printer disclosed in Japanese Laid-Open Utility Model Publication No. 5-86541, the rolled sheet holder may rattle with respect to the printer body when the sheet is drawn from the roll of paper that is supplied to the printer body from the rolled sheet holder. The rolled sheet holder may rattle because the rolled sheet holder is merely attached to the printer body. Due to the rattling of the rolled sheet holder, the continuous sheet may not be conveyed in a direction parallel to the sheet conveying direction, thereby causing a sheet conveying failure.

In the ink-jet recording apparatus disclosed in Japanese Laid-Open Patent Publication No. 10-279151, a user needs to manually pinch the leading edge portion of the sheet drawn from the roll of paper, between the auxiliary sheet supply rollers. As such, the leading edge portion may not be positioned at the same position at all times. For example, the leading edge portion of the sheet is located at a position short of the auxiliary sheet supply rollers (at a position upstream of the auxiliary sheet supply rollers in a sheet conveying direction). When this happens, the sheet cannot be conveyed to the printing position.

There are two types of ways to set a roll of paper in an ink-jet recording apparatus. One way is that a roll of paper is loaded into a rolled sheet holder integrally provided to a printer body like the printer disclosed in Japanese Laid-Open Patent Publication No. 10-279151. Another way is that a roll of paper is attached to a printer body via a detachably cassette with respect to the printer body. In the latter way, the cassette can be removed from the printer body, so that there is flexibility in setting of the roll of paper. However, in both occurrences, the above-described problems may occur.

SUMMARY OF THE INVENTION

The invention thus provides, among other things, a rolled recording medium cassette and an image forming apparatus wherein rattling of the rolled recording medium cassette is restricted when a recording medium is conveyed and a recording medium conveyance failure is prevented so that the recording medium is surely conveyed to an image forming position.

According to one exemplary aspect of the invention, a cassette attachable to a body of an image forming apparatus includes a support portion that rotatably supports a roll in which a recording medium is wound, a guide member that guides, along a recording medium conveying path, the recording medium drawn from the roll supported by the support portion, and a stopper that selectively locates at a blocking position that blocks the recording medium conveying path and at an unblocking position that does not block the recording medium conveying path.

According to one exemplary aspect of the invention, an image forming apparatus includes a support portion that rotatably supports a roll in which a recording medium is wound, a guide member that guides, along a recording medium conveying path, the recording medium drawn from the roll supported by the support portion, a stopper that selectively locates at a blocking position that blocks the recording medium conveying path and at an unblocking position that does not block the recording medium conveying path, a sheet supply mechanism that conveys the recording medium from an upstream side to a downstream side with respect to the stopper, and an image forming unit that forms an image onto the recording medium at a position downstream of the stopper.

With this structure, when the roll of recording medium is attached to the cassette, the leading edge of the recording medium can always be positioned at a certain position because the roll is supported by the support portion, the leading edge portion of the recording medium is advanced along the conveying path constituted by the guide member, and the leading edge of the recording medium is abutted against the stopper that blocks the conveying path by changing the position of the stopper to the unblocking position. Accordingly, the recording medium can be surely conveyed to the image portion position.

Further, at the time the cassette is attached to the image forming apparatus, the leading edge of the recording medium is located at a certain position. Therefore, a distance that the leading edge of the recording medium travels from the certain position to the image forming position is constant at all times, so that a distance sufficient to adjust the position of the recording medium in the width direction to a proper position can be ensured by which the recording medium is moved with its side edge moving along a reference plane. Accordingly, a deviation of the recording medium in the width direction can be restricted during the image forming operation.

According to still another exemplary aspect of the invention, a cassette is attached to a body of an image forming apparatus includes a first end face, that faces the body, of a portion included in a recording medium conveying path provided in the cassette that is urged so as to rotate in a direction toward a second end face, that faces the rolled recording medium cassette, of a portion included in the recording medium conveying path provided in the body, about a position where the cassette is attached to the body of the image forming apparatus.

With this structure, the first end face can be intimately contacted to the second end face while the cassette is attached to the body of the image forming apparatus. Accordingly, when the recording medium is conveyed from the cassette to the body, the rattling of the rolled recording medium can be restricted, thereby smoothly conveying the recording medium.

BRIEF DESCRIPTION OF THE DRAWINGS

An embodiment of the invention will be described in detail with reference to the following figures wherein.

DETAILED DESCRIPTION OF PREFERRED EMBODIMENTS

Figure 1:
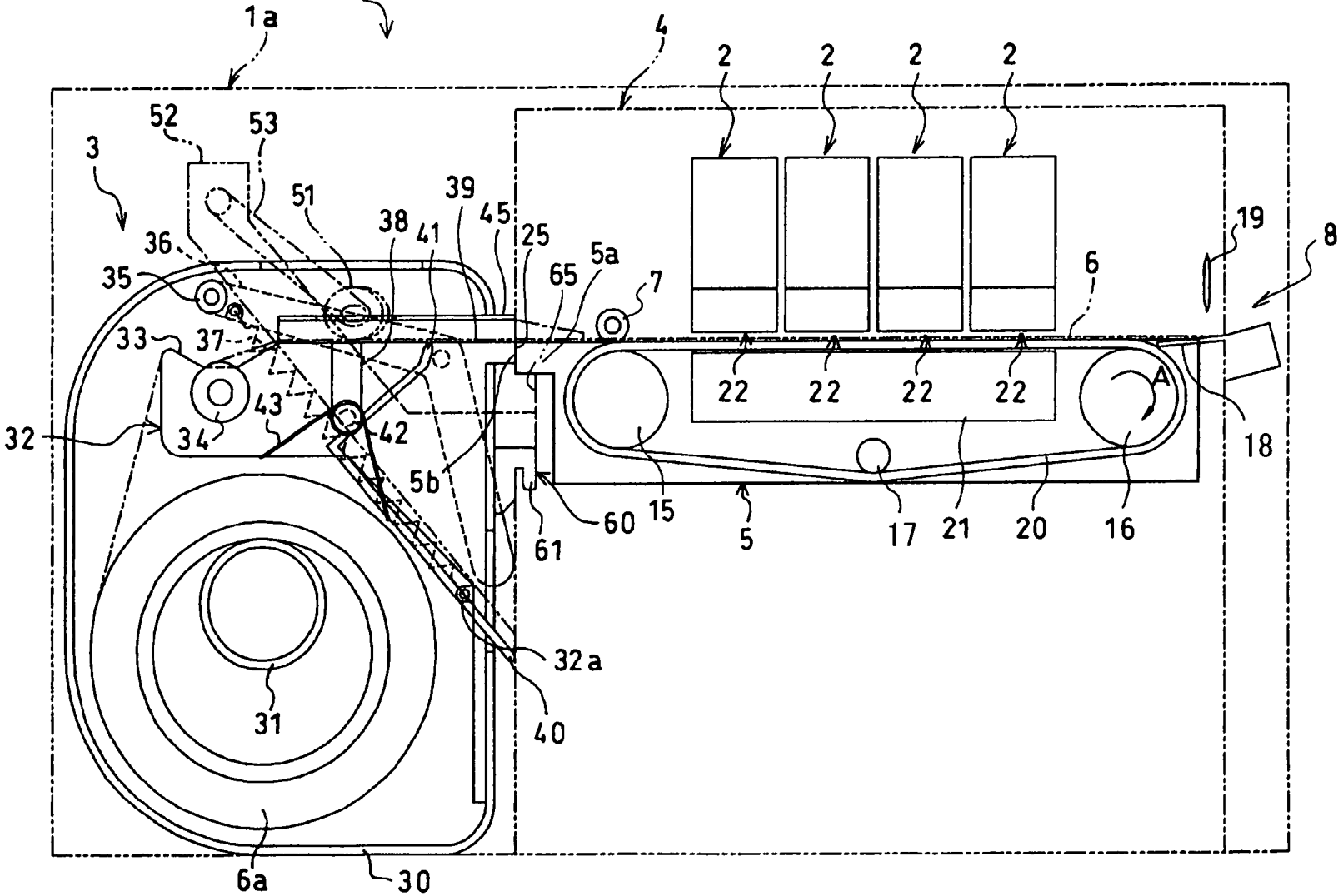
FIG. 1 is a side view of a structure of an ink jet printer according to an embodiment of the invention.

An embodiment of the invention will be described with reference to the accompanying drawings. As shown in FIG. 1, a color ink-jet printer 1 includes four ink-jet heads 2. A printer body 1*a* of the ink-jet printer 1 can accommodate a detachably attachable sheet cassette 3. The sheet cassette 3 rotatably supports therein a roll of paper 6*a* in which a continuous long sheet 6 is wound around a cylindrical paper tube. A main chassis 4 of the printer body 1*a* is provided on the right of a sheet cassette accommodating position, in FIG. 1. On the right of the main chassis 4, a sheet discharge portion 8 is provided.

In the ink-jet printer 1, a sheet conveying path extends from the sheet cassette 3 to the sheet discharge portion 8. In the middle of the sheet conveying path, a unit chassis 5 is provided in the main chassis 4 so as to face bottom surfaces of the ink-jet heads 2. The unit chassis 5 includes two plate-like members (not shown) which are connected with each other by a plurality of connecting members (not shown). The plate-like members are positioned in parallel to and apart from each other in a direction perpendicular to a sheet conveying direction. The unit chassis 5 has a projection 5*a* projecting so as to reach a surface of the sheet cassette 3 when the sheet cassette 3 is attached to the printer body 1*a*. An upper surface of the projection 5*a* constitutes a part of the sheet conveying path. An end face (first end face) 5*b* (FIG. 4) of the projection 5*a* extends in a direction perpendicular to a sheet conveying direction of a conveyor belt 20.

In the unit chassis 5, two belt rollers 15, 16 are rotatably supported, around which the endless conveyor belt 20 is wound. An outer surface (conveyor surface) of the conveyor belt 20 has adhesion with silicone coating. The belt roller 16 is driven by a rotation drive device (not shown). The belt roller 15 is a driven roller which rotates in accordance with a rotation of the conveyor belt 20. A movable tension roller 17 is supported in the unit chassis 5, between the belt rollers 15 and 16, so as to tension the conveyor belt 20 by contacting a lower inner surface of the conveyor belt 20. The tension roller 17 can move in an up-and-down direction and can be kept at the upper position and the lower position. In the lower position, the tension roller 17 can place an appropriate tension on the conveyor belt 20.

A pressing roller 7 is disposed immediately downstream of the sheet cassette 3 in the sheet conveying direction, so as to press the sheet 6, drawn from the roll of paper 6*a*, toward the conveyor belt 20. The sheet 6 is pressed against the conveyor belt 20 by the pressing roller 7 to be adhered to the adhesive conveyor belt 20, and then is conveyed downstream (rightward in FIG. 1) by the rotation (indicated by an arrow A) of the belt roller 16 in a clockwise direction.

A separating mechanism 18 is provided on the right of the conveyor belt 20 in FIG. 1, so as to separate the sheet 6 adhering to the conveyor belt 20 from its conveyor surface. A cutter 19, which can move up and down, is disposed above the separating mechanism 18 so as to cut the sheet 6, which is drawn from the roll of paper 6*a* and separated from the conveyor surface by the separating mechanism 18, at an appropriate position.

A box-shaped guide member 21, having the substantially same width as the conveyor belt 20, is provided within an area surrounded by the conveyor belt 20 so as to face the ink-jet heads 2 while sandwiching the upper part of the conveyor belt 20. That is, to support the conveyor belt 20 by contacting the inner surface of the upper part of the conveyor belt 20.

Each of the ink-jet heads 2 has a head body 22 (wherein an ink passage unit, which is provided with an ink passage including pressure chambers, and an actuator, which applies pressure to ink stored in the pressure chambers, are adhered to each other) at its bottom. Each head body 22 has a rectangular shape in cross section. The head bodies 22 are disposed adjacent to each other such that their longitudinal sides extend in a direction perpendicular to the sheet conveying direction (in a direction perpendicular to the drawing sheet of FIG. 1). That is, the ink-jet printer 1 is a line printer. A bottom surface of each of the head bodies 22 faces the sheet conveying path and has a plurality of nozzles 22*a* (FIG. 2) having an extremely small diameter. The head bodies 22 eject respective colors of ink droplets, such as magenta, yellow, cyan and black ink.

The head bodies 22 are disposed so that a small clearance is provided between the lower surfaces of the head bodies 22 and the conveyor surface of the conveyor belt 20. The small clearance constitutes a part of the sheet conveying path. When the sheet 6 on the conveyor belt 20 passes under the head bodies 22, ink droplets are ejected from the nozzles 22*a* onto an upper surface (a recording surface) of the sheet 6, whereby a desired color image is formed on the sheet 6.

Figure 2:
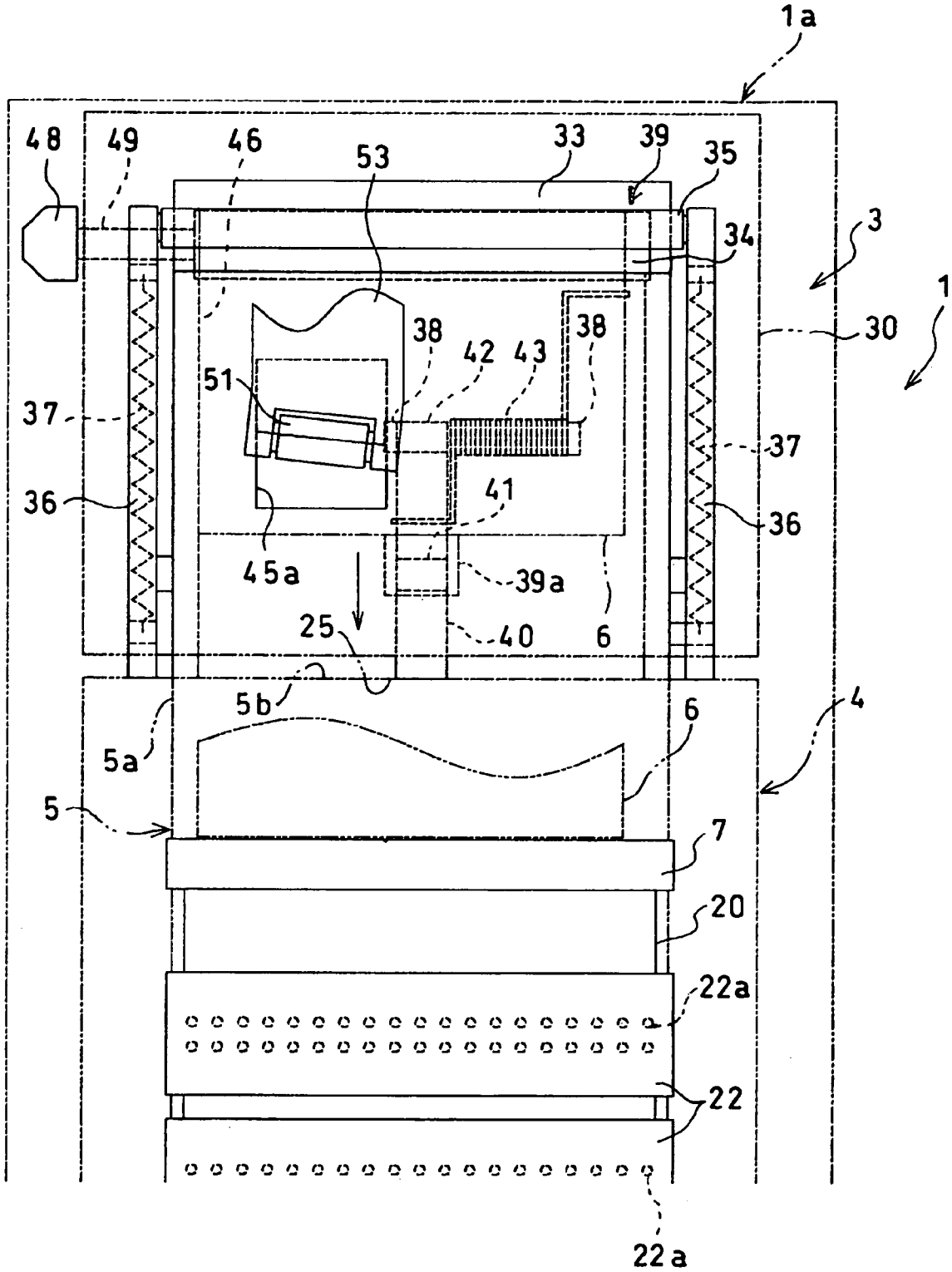
FIG. 2 is a schematic diagram showing the surroundings of a sheet cassette provided in the ink-jet printer of FIG. 1.

As shown in FIGS. 1 and 2, the sheet cassette 3 for supplying a sheet 6 onto the conveyor belt 20 has a case 30 dividable into two parts (right and left parts). The case 30 has a substantially box shape with openings. A sheet supply roller 51 and end portions of levers 36, 40 project and retract from the respective openings. A cylindrical member 31 for rotatably supporting the roll of paper 6 protrudes from an inner surface of one of the parts of the case 30. A diameter of the cylindrical member 31 is smaller than the diameter of the paper tube of the roll of paper 6. Thus, the roll of paper 6 is rotatably supported with respect to the cylindrical member 31 by hanging from the cylindrical member 31.

Figure 3:
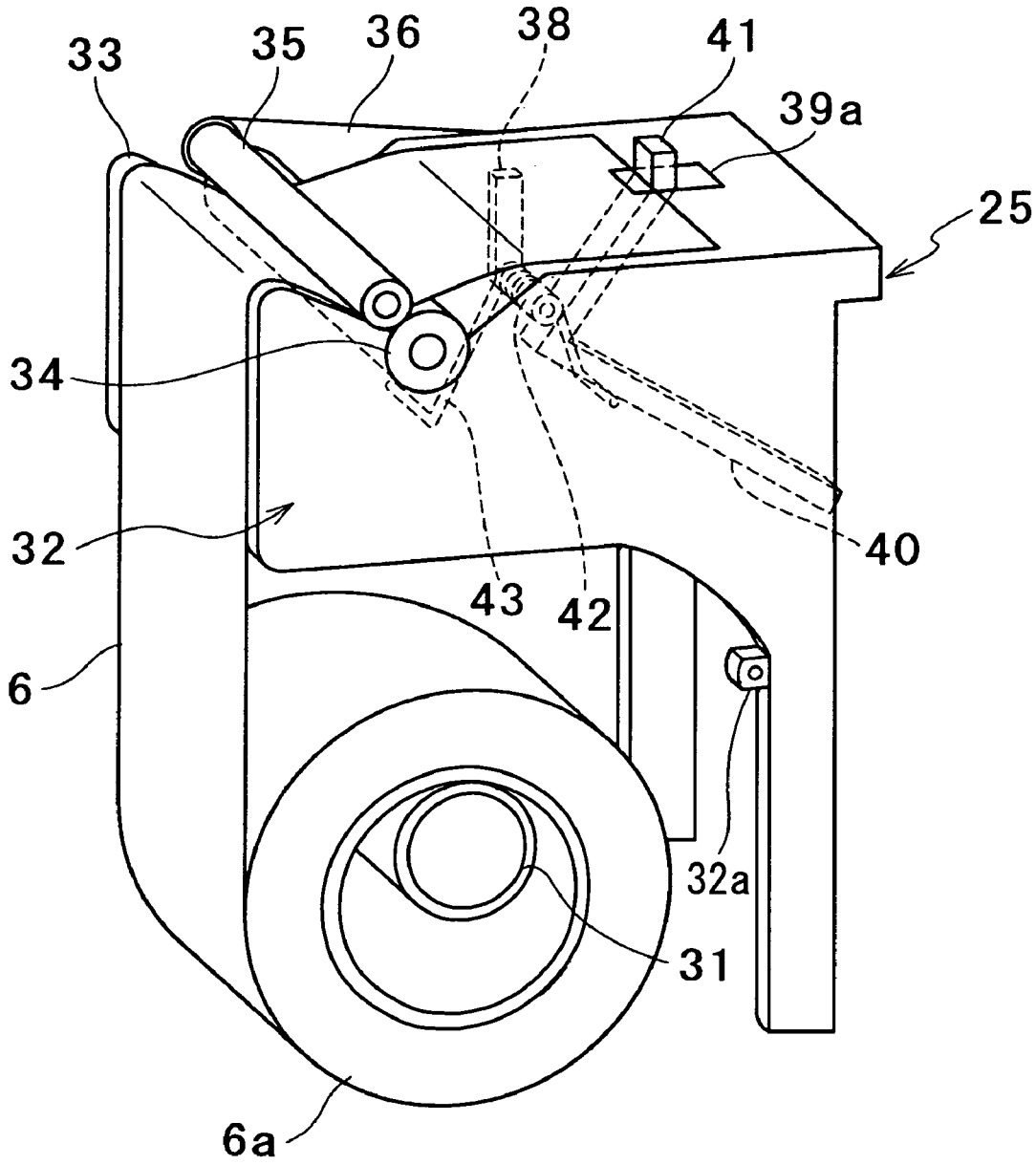
FIG. 3 a perspective view showing a part of the sheet cassette provided in the ink-jet printer of FIG. 1.

As shown in FIG. 3, a guide member 32 is fixedly provided in the case 30. An upstream end portion of an upper surface 39 of the guide member 32 in the sheet conveying direction is provided with a V-shaped cutaway portion 33. A curl correcting roller 34 is rotatably supported with respect to the guide member 32 at the bottom of the cutaway portion 33. The sheet 6 drawn from the roll of paper 6*a* is guided to the conveyor belt 20, along the upper surface 39 of the guide member 32.

Figure 4:
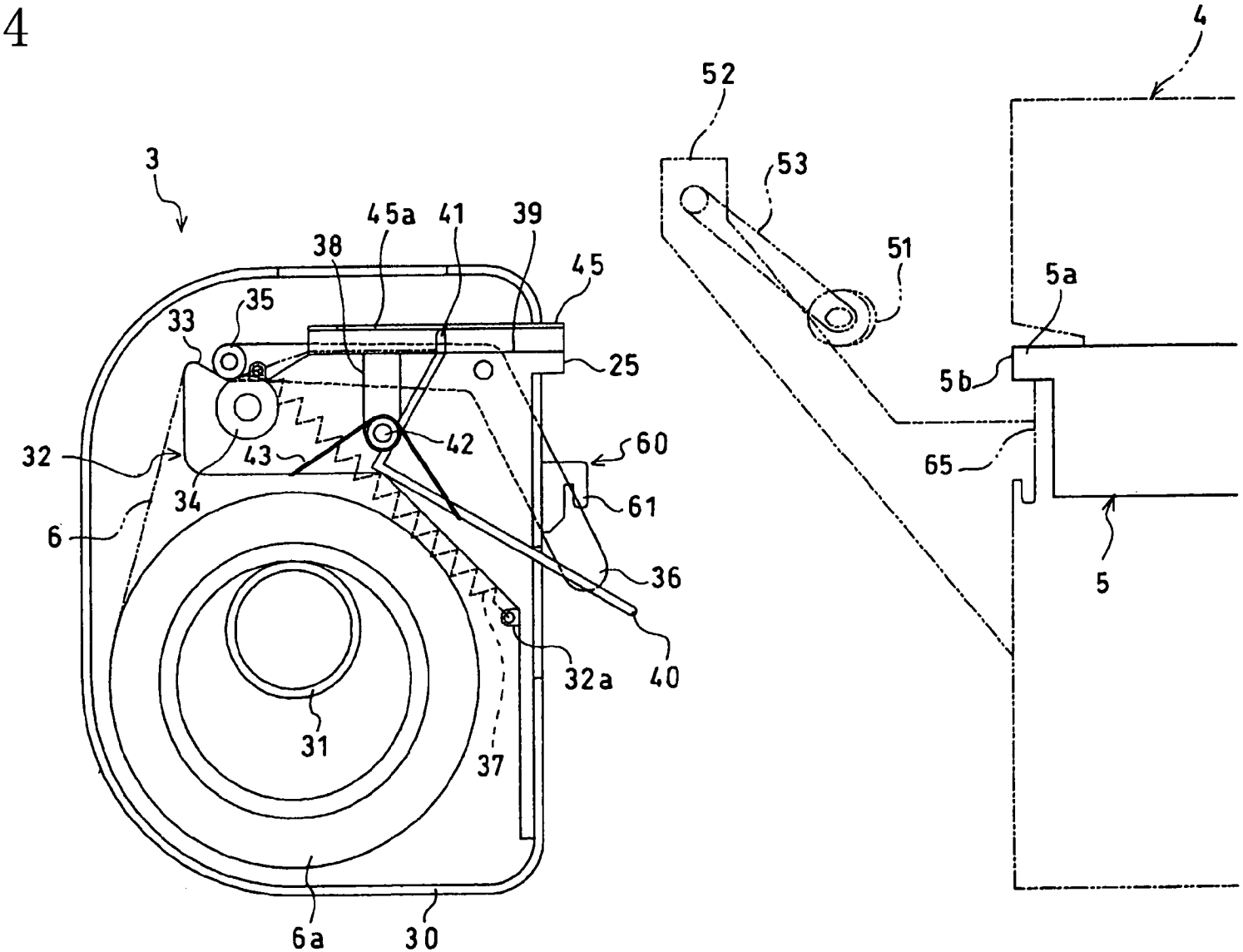
FIG. 4 is a schematic diagram showing a state where the sheet cassette is separated from the ink-jet printer.

As shown in FIGS. 1 and 2, the two V-shaped levers 36 are attached to respective side surfaces of the guide member 32 so that the levers 36 can rotate about their corner portions. A curl correcting roller 35 is attached to one of the ends of the levers 36 so as to be rotatable about its shaft. When the correcting roller 35 is in contact with the correcting roller 34, the other ends (free ends) of the levers 36 protrude from the respective openings provided in the case 30. In each lever 36, a portion adjacent to the correcting roller 35 is engaged with one end of a spring 37 and the other end of the spring 37 is engaged with a fixing portion 32*a* of the guide member 32. The levers 36 are urged in a direction such that the correcting roller 35 approaches the correcting roller 34 by the springs 37. Accordingly, while the sheet cassette 3 is not attached to the printer body 1*a*, as shown in FIG. 4, the correcting roller 35 is intimately contacted with the correcting roller 34 and the other ends of the levers 36 protrude from the openings provided in the surface of the case 30 on the main chassis side.

The correcting roller 35 contacts the correcting roller 34 at a position deviating from a center of the correcting roller 34. That is, at an upper left position in FIG. 1 with respect to the center of correcting roller 34. With this structure, the correcting rollers 34, 35 can exert a force which causes a curl in a direction reverse to the warping direction of the curl due to the winding of the sheet 6, the correcting rollers 34, 35 can exert the force to the leading portion of the sheet 6 while the sheet 6 passes between the correcting rollers 34 and 35 along the cutaway portion 33 provided in the upper surface 39 of the guide member 32. As such, a curving direction of the leading portion of the sheet 6 is changed between, before and after the sheet 6 passes between the correcting rollers 34, 35. Thus, the curl of the leading portion of the sheet 6 is corrected by the correcting rollers 34, 35. As described above, in this embodiment, the correcting rollers 34, 35 and the cutaway portion 33 formed in the upper surface 39 of the guide member 32 function as a curl correcting mechanism for correcting the curl of the leading portion of the sheet 6.

As shown in FIGS. 1 to 3, the guide member 32 has a hollow body. Two protrusions 38 protrude downward from an inner surface of the upper surface 39 of the guide member 32. The L-shaped lever 40 is provided between lower end portions of the protrusions 38 such that the lever 40 can rotate about a cylindrical member 42 provided near its corner portion. A coil spring 43 is provided between the lower end portions of the protrusions 38 so that the coil spring 43 is coaxial with the cylindrical member 42. One end of the coil spring 43 on the main chassis side is engaged to the lower portion of the lever 40 and the other end is engaged to a position below the cutaway portion 33 provided in the upper surface 39 of the guide member 32. As described above, the lever 40 is urged by the coil spring 43 in a direction (a counterclockwise direction in FIG. 1) to rotate so that an upper end portion of the lever 40 protrudes from an opening 39*a* provided, in the upper surface 39, downstream of the cutaway portion 33 in the sheet conveying direction. When the upper end portion of the lever 40 protrudes from the opening 39*a*, a lower end portion of the lever 40 protrudes from the opening provided in the wall of the case 30 on the main chassis side. Thus, while the sheet cassette 3 is not attached to the printer body 1*a*, as shown in FIG. 4, the upper end portion of the lever 40 protrudes from the opening 39*a* and the lower end portion of the lever 40 protrudes from the opening provided in the wall of the case 30 on the main chassis side. The upper end portion of the lever 40, which protrudes and retracts from the opening 39*a* of the guide member 32, functions as a stopper 41 for positioning the sheet 6 as described later.

As shown in FIG. 1, a passage member 45 is provided above the guide member 32 except for the cutaway portion 33 of the upper surface 39. The passage member 45 is a plate-like member whose side portions, that extend along the sheet conveying path, are bent downward. An area surrounded by an internal surface of the passage member 45 and the upper surface 39 of the guide member 32 constitutes a part of the sheet conveying path in the sheet cassette 3. The passage member 45 has an opening 45*a* (FIG. 2) that the sheet supply roller 51 enters and exits therefrom. A downstream end portion of the passage member 45 horizontally protrudes from the surface of the sheet cassette 3 on the main chassis side toward the surface of the main chassis 4 together with the portion defining the upper surface 39 of the guide member 32. An end face (second end face) 25 of the portion providing the upper surface 39 extends in a direction perpendicular to the sheet conveying direction.

As shown in FIG. 2, an operating knob 48 is attached to one end of the correcting roller 34. In particular, the operating knob 48 is attached to an end of a shaft 49 extending from the correcting roller 34. Corners of the operating knob 48 are rounded and the operating knob 48 has a substantially circular cylinder shape. The correcting roller 34 rotates when a user turns the operating knob 48 by hand.

As shown in FIGS. 1 and 4, two support members 52 upwardly extend from the surface of the main chassis 4 on the side of the sheet cassette 3, in a slanting direction toward a position beyond the upper surface of the case 30. An arm 53 is attached to the support members 52, near their ends. The arm 53 downwardly extends in a slanting direction from the end portions of the support members 52 and can swing about the points connecting the support members 52. The sheet supply roller 51 for supplying the sheet 6 drawn from the roll of paper 6*a* to the conveyor belt 20 is rotatably supported by the end portions of the arm 53. The sheet supply roller 51 is driven by a drive source (not shown) so as to rotate about its axis. The sheet supply roller 51 is supported by the arm 53 while its rotational shaft slants approximately 3 degrees in the clockwise direction with respect to the direction perpendicular to the sheet conveying direction in FIG. 2.

In this embodiment, when the sheet cassette 3 is attached to the printer body 1*a*, the sheet supply roller 51 is positioned in the opening 45*a* of the passage member 45 through the opening provided in the upper surface 39 of the case 30. In the opening 45*a* of the passage member 45, a center of the sheet supply roller 51 is positioned at a distance of 30 mm from a reference plane (a plane extending along the sheet conveying direction of the passage member 45) 46, which is defined by the left side surface of the passage member 45 in FIG. 2, and at a distance of 50 mm from a center shaft of the pressing roller 7. In a state where the sheet supply roller 51 is positioned in the opening 45*a*, the sheet supply roller 51 conveys the sheet 6 downstream while exerting its own weight on the sheet 6 positioned below the sheet supply roller 51.

As the sheet supply roller 51 is driven, the sheet 6, drawn from the roll of paper 6*a*, is conveyed toward the pressing roller 7. In this embodiment, because the rotational shaft of the sheet supply roller 51 is slanting, the sheet 6 is forcefully pulled so that the side of the sheet 6 approaches the reference plane 46. Thus, the sheet 6 moves to a proper position in the sheet width direction.

As described above, the rotational shaft of the sheet supply roller 51 slants 3 degrees with respect to the direction orthogonal to the sheet conveying direction. With this structure, it is unnecessary to stop the sheet feeding operation in order to correct the skew of the sheet 6 drawn from the roll of paper 6*a*, so that the sheet 6 can be successively supplied or conveyed. Further, an excessive correcting force is not applied to the sheet 6, so that a weak or thin sheet can also be conveyed without warping. In this embodiment, the sheet supply roller 51, the arm 53 and the support members 52 constitute the sheet feed mechanism.

As shown in FIG. 4, an attachment 60 having a downwardly extending projection 61 at its end is provided to the surface of the sheet cassette 3 on the main chassis 4 side. A recess 65, which has substantially the same shape as the outer shape of the projection 61 of the attachment 60, is provided in the surface of the main chassis 4 on the sheet cassette side. By fitting the projection 61 of the attachment 60 into the recess 65 of the main chassis 4, the sheet cassette 3 can be stably attached to the printer body 1*a*. In the state where the sheet cassette 3 is attached to the printer body 1*a*, the surface of the main chassis 4 faces the surface of the sheet cassette 3 with both surfaces placed close to each other. The attachment 60 is provided at both sides of the sheet cassette 3. Both of the attachments 60, located at both sides of the sheet cassette 3, have the same shape. The recess 65, which is to be engaged with the attachment 60, is also provided at both sides of the main chassis 4 so as to correspond to the respective attachments 60.

Procedures for loading a continuous roll of paper 6*a* into the sheet cassette 3 will be described below. First, the roll of paper 6 is inserted into the cylindrical member 31 provided to one of the parts constituting the case 30, so that the roll of paper 6 hangs from the cylindrical member 31. The part having the cylindrical member 31 of the case 30 is connected with a connect portion (not shown) of the guide member 32.

Then, a sheet 6 is drawn from the roll of paper 6*a* and a leading edge of the sheet 6 is pinched between the correcting rollers 34 and 35 with lying along the cutaway portion 33 of the guide member 32. At that time, the correcting roller 35 is in contact with the correcting roller 34 by the springs 37 connected with the respective levers 36. Therefore, a user uplifts the correcting roller 35 to disengage the correcting roller 35 from the correcting roller 34 for pinching the leading edge of the sheet 6 between the correcting rollers 34 and 35. After that, the other part of the case 30 is connected to the connect portion (not shown) of the guide member 32 to integrate the divided case 30 with the guide member 32 and to support the roll of paper 6*a*.

The operating knob 48, which is attached to the shaft 49 extending from the center of the correcting roller 34, is turned by the user to rotate the correcting roller 34 in the clockwise direction in FIG. 4. At that time, the correcting roller 35 sandwiching the sheet 6 in cooperation with the correcting roller 34 rotates in the counterclockwise direction in accordance with the rotation of the correcting roller 34. While the sheet 6 is conveyed in the sheet conveying direction by the rotation of the correcting roller 34, the leading edge portion of the sheet 6 passes between the correcting rollers 34 and 35, resulting in a curl of the leading edge portion of the sheet 6 being corrected. Then, the leading edge portion of the sheet 6 is further conveyed to the sheet conveying path defined by the upper surface 39 of the guide member 32 and the passage member 45.

The operating knob 48 is turned until the leading edge of the sheet 6 in the sheet conveying path abuts against the upper end portion (i.e., the stopper 41) of the lever 40, which is protruding from the opening 39*a* of the guide member 32 to block the sheet conveying path in order to position the leading edge of the sheet 6 in the sheet conveying path. That is, the lever 40 is urged in the counterclockwise direction in FIG. 4, by the coil spring 43, and the upper end portion of the lever 40 protrudes from the opening 39*a* of the guide member 32 to function as the stopper 41 to block the sheet conveying path. With this structure, the user can confirm a position where the leading edge of the sheet 6 should be stopped, by turning the operating knob 48 to abut the leading edge of the sheet 6 against the stopper 41 of the lever 40. Thus, the leading edge of the sheet 6 can be positioned at the certain position at all times when the roll of paper 6*a* is loaded into the sheet cassette 3. In addition, a distance between a sheet feeding start position and the pressing roller 7 is the same every time the sheet 6 is supplied. As such, a distance, which is adequate for adjusting the sheet position by moving the sheet 6 along the reference plane 46 by the sheet supply roller 51, can be maintained in order to locate the sheet 6 to the proper position in the width direction.

Only by performing a simple operation of turning the operating knob 48 after the leading edge of the sheet 6 is pinched between the correcting rollers 34 and 35, the sheet 6 can be conveyed along the upper surface 39 of the guide member 32. In addition, the correction of a curl of the leading edge portion of the sheet 6 by the correcting rollers 34, 35 and the abutment of the leading edge of the sheet 6 against the stopper 41 protruding from the opening 39*a* of the guide member 32 can be performed within a short time. Thus, the loading of the roll of paper 6*a* into the sheet cassette 3, which is not attached to the printer body 1*a*, is completed.

Procedures for attaching the sheet cassette 3 having the roll of paper 6*a* therein to the printer body 1*a* will be described. In order to attach the sheet cassette 3 to the printer body 1*a*, as shown in FIG. 5, the projections 61 of the attachments 60 provided at the surface of the sheet cassette 3 are fitted into the respective recesses 65 provided in the main chassis 4.

Figure 5:
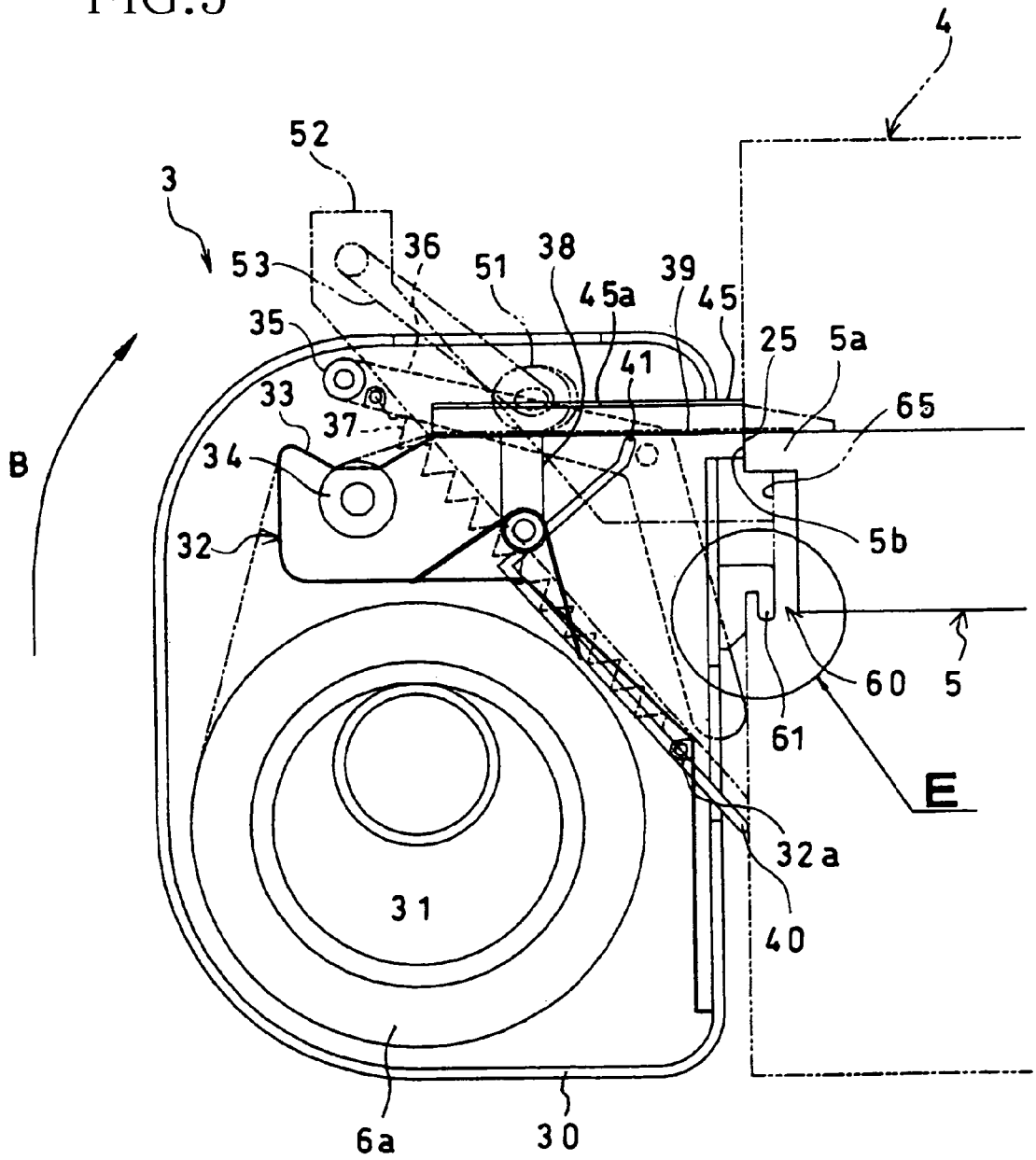
FIG. 5 is a schematic diagram showing a state where the sheet cassette is attached to the ink-jet printer.
Figure 6:
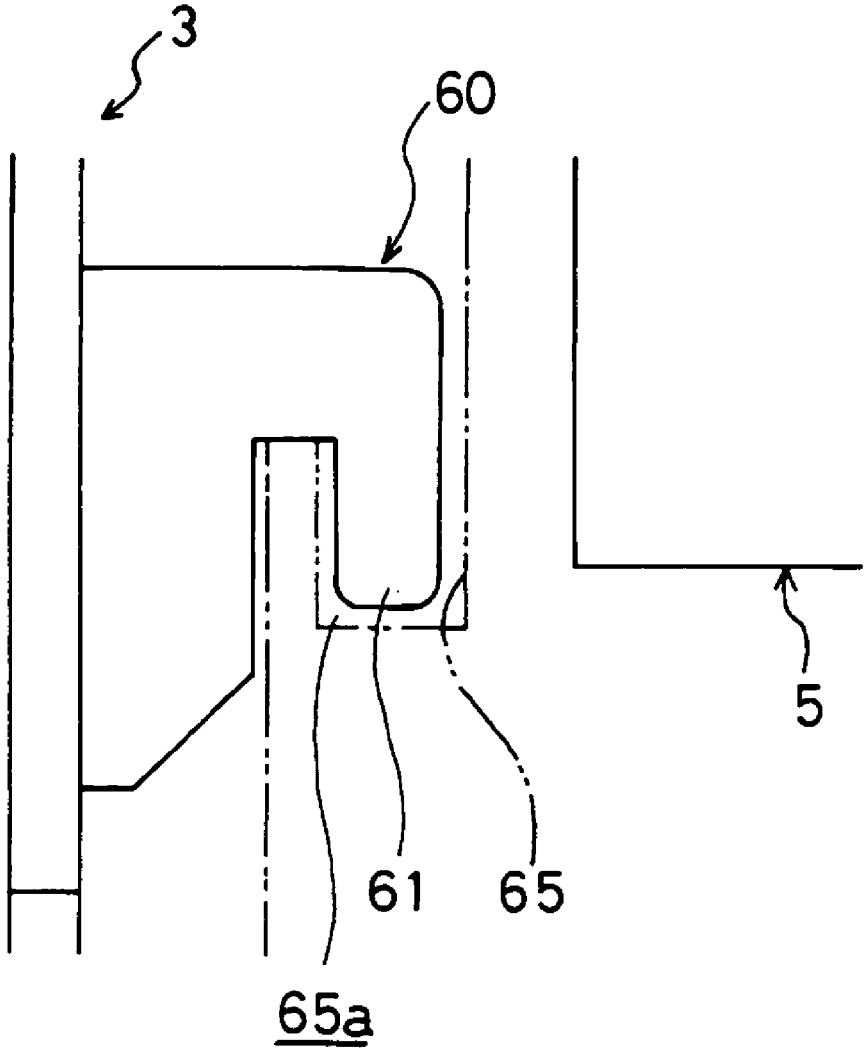
FIG. 6 is an enlarged view of a portion indicated by E in FIG. 5.

FIG. 6 is an enlarged view of a portion indicated by E of FIG. 5. For the sake of convenience, a description will be given to one of the protrusions 61. As shown in FIG. 6, an appropriate clearance 65*a* is provided between the projection 61 of the attachment 60 and the recess 65 of the main chassis 4 so as to contact the end face 25 and the end face 5*b* at their surfaces when the sheet cassette 3 is attached to the printer body 1*a* as shown in FIG. 6. That is, when the sheet cassette 3 is attached to the printer body 1*a* and the end face 25 and the end face 5*b* contact each other only at their points (i.e., at an upper corner of the end face 25 and the end face 5*b*), the projection 61 of the attachment 60 can move in the clearance 65*a*. Thus, the end face 25 and the end face 5*b* can contact each other at their surfaces.

When the sheet cassette 3 is brought closer to the main chassis 4 of the printer body 1*a* in order to fit the projections 61 of the attachments 60 into the recesses 65 of the main chassis 4, the ends of the levers 36, 40 protruding from the openings of the main chassis side of the case 30 contact the surface of the main chassis 4. The levers 36, 40 thereby rotate in the clockwise direction against the urging force from the springs 37 and the coil spring 43. In accordance with the rotation of the levers 36, 40, the correcting roller 35 moves away from the correcting roller 34 and the stopper 41 protruding from the opening 39*a* moves to a position that does not block the sheet conveying path (a position below the opening 39*a*).

At that time, the springs 37 connected with the levers 36 and the coil spring 43 connected with the lever 40 exert their forces on the respective levers 36, 40 to rotate them in the counterclockwise direction in FIG. 5. Because the ends of the levers 36, 40 protruding from the opening of the case 30 are contacted with the surface of the sheet cassette 3, the sheet cassette 3 is applied with a force to rotate in the clockwise direction (in a direction indicated by an arrow B in FIG. 5) about a position in which the attachments 60 contact the respective recesses 65 (a position where the sheet cassette 3 engages the main chassis 4).

Accordingly, the end face 25 of the sheet cassette 3, which is an end face of the part protruding from the sheet cassette 3 to constitute the upper surface of the guide member 32, intimately contacts the end face 5*b* of the projection 5*a*, protruding horizontally, of the unit chassis 5. Therefore, when the sheet 6 is conveyed in the sheet conveying direction by which the sheet 6 is adhered to the conveyor belt 20, the sheet 6 drawn from the roll of paper 6*a* can be smoothly conveyed without the sheet cassette 3 rattling.

After that, the sheet supply roller 51 is positioned in the opening 45*a* of the passage member 45, from above the sheet cassette 3, in order to contact the sheet 6 whose leading edge is positioned by the stopper 41. As described above, the sheet cassette 3 is attached to the main chassis 4, and thus, the storage of the sheet cassette 3 into the cassette storage position in the printer body 1*a* is completed.

The sheet 6, whose leading edge is positioned at the certain position by the stopper 41, is conveyed downstream with respect to the stopper 41 in the sheet conveying direction. That is, the sheet 6 is conveyed to the pressing roller 7 provided in the printer body 1*a* by the rotation of the sheet supply roller 51. When the leading edge of the sheet 6 is positioned, the curl of the leading edge portion of the sheet 6 has already been corrected. As such, the leading edge portion of the sheet 6 is smoothly conveyed to the printer body 1*a*. Because the sheet 6 is conveyed with its one side being moved along the reference plane 46 (the left plane shown in FIG. 2) by the sheet supply roller 51, the sheet 6 is moved to the proper position in its width direction. Therefore, the sheet 6 can be prevented from deviating in its width direction during the printing operation.

After the leading edge portion of the sheet 6 is adhered to the adhesive conveyor surface of the conveyor belt 20 by the pressing roller 7, the sheet 6 is conveyed to the position under the ink-jet heads 2 by the rotation of the conveyor belt 20. In accordance with the movement of the leading edge portion adhered to the conveyor belt 20, in the conveying direction, the continuous sheet 6 is drawn from the roll of paper 6*a* and adhered to the conveyor surface of the conveyor belt 20 by the pressing roller 7. As the sheet 6 reaches a printing position where the ink-jet heads 2 are provided, a desired image is formed onto the sheet 6 by ejecting ink droplets by the ink-jet heads 2. Then, the sheet 6 is separated from the conveyor belt 20 by the separating mechanism 18 from its leading edge. The separated leading edge portion is further conveyed to the sheet discharge portion 8 and the continuous sheet 6 is cut at an appropriate position by the cutter 19. The sheet conveying direction before the sheet 6 reaches the pressing roller is substantially the same as the sheet conveying direction by the conveyor belt 20, so that a conveying failure does not occur even when the sheet 6 is continuously conveyed. Further, the curl of the leading edge portion, onto which an image is to be formed by the ejection of ink droplets by the ink-jet heads 2, has been corrected before the sheet cassette 3 is attached to the main chassis 4, because the correcting rollers 34, 35 apply a force on the leading edge portion to make the leading edge portion curl in a direction reverse to the curl developed at the leading edge portion. Therefore, ink droplet landing accuracy by the ink-jet heads 2 becomes high, resulting in an improvement in the printing quality. In addition, the leading edge portion of the sheet 6 can be prevented from rubbing the surfaces of the ink-jet heads 2.

As described above, in the sheet cassette 3 of the ink-jet printer 1 according to the embodiment, the rattling of the sheet cassette 3 with respect to the printer body 1*a* can be restricted by the simple structure using the springs 37 and the coil spring 43, as elastic members, which generate resilience by the rotation of the levers 36, 40, whose one ends contact the printer body 1*a*. Accordingly, when the sheet 6 is supplied to the printer body 1*a* from the sheet cassette 3, the sheet 6 can be smoothly conveyed.

Only by attaching the sheet cassette 3 to the printer body 1*a*, the upper end portion of the lever 40, that is the stopper 41, can be moved from the blocking position to the unblocking position in the sheet conveying path in the sheet cassette 3. Therefore, the user does not need to perform an operation to move the stopper 41 to the unblocking position. In addition, the curl correcting roller 35 can be disengaged from the curl correcting roller 34 only by attaching the sheet cassette 3 to the printer body 1*a*. With this structure, the user does not need to perform an operating to separate the curl correcting roller 35 from the curl correcting roller 34 so that a portion of the sheet 6, other than the leading edge portion, is not unnecessarily applied with a curl correcting force. Furthermore, because the curl correcting rollers 34, 35 are not in contact with each other while the sheet 6 is conveyed, a load on the conveyance of the sheet 6 due to the curl correcting force applied by the correcting rollers 34, 35 can be reduced and the sheet 6 can be smoothly conveyed to the printing position. With the use of the roll of paper 6*a* as a recording medium, the sheet cassette 3 can be compact in size.

The leading edge of the sheet 6 can be positioned before the sheet cassette 3 is attached to the printer body 1*a* because the sheet conveying path is blocked by the stopper 41 in the sheet cassette 3. Therefore, the leading edge of the sheet 6 can be maintained at the certain position at all times when the sheet cassette 3 is attached to the printer body 1*a*. Thus, the sheet 6 can be surely conveyed to the printer body 1*a* by the sheet supply roller 51.

The leading edge of the sheet 6 is maintained at the certain position when the sheet cassette 3 is attached to the printer body 1*a*. As such, a distance that the leading edge of the sheet 6 travels from the certain position to the printing position is always the same length. Therefore, a distance sufficient to adjust the sheet 6 to the proper position in the width direction by moving the sheet 6 along the reference plate 46 can be ensured. Thus, the sheet 6 can be prevented from deviating in the sheet width direction.

While the invention has been described in detail with reference to the specific embodiment thereof, it would be apparent to those skilled in the art that various changes, arrangements and modifications may be applied therein without departing from the spirit and scope of the invention. For example, it is unnecessary to provide the levers 36, 40, the springs 37 and the coil spring 43 in the sheet cassette 3. Instead, a sheet cassette can be provided with an extendable member which can horizontally stretch from a surface opposite to the end face 25 of the portion constituting the upper surface of the guide member 32, with respect to the center of rotation where the attachments 60 of the sheet cassette 3 and the recesses 65 of the main chassis 4 contact with each other. That is, when such a sheet cassette is attached to the main chassis 4, the sheet cassette can receive a reaction from the surface of the main chassis 4 by horizontally projecting a cylinder from the sheet cassette. Thus, the sheet cassette is rotated about the center of rotation described above, so that the sheet cassette is urged in a direction to move the end face 25 of the portion constituting the upper surface of the guide member 32 closer to the end face 5*b* of the projected portion 5*a* of the sheet cassette 3. Thus, the end faces 5*b*, 25 are intimately contacted with each other, so that the rattling of the sheet cassette 3 with respect to the printer body 1*a* can be restricted when the sheet 6 is supplied to the printer body 1*a* from the sheet cassette 3, thereby smoothly conveying the sheet 6.

The shapes of the levers 36, 40 are not limited to those described in the above embodiment. A lever or device can be used such that the resilience of elastic member to intimately contact the end face 25 and end face 5*b* can be obtained when the sheet cassette 3 is attached to the main chassis 4.

The invention can be applied to not only an ink-jet printer but also various image forming apparatuses, such as a thermal printer, a dot printer, and a laser beam printer. Further, the invention can be applied to a serial ink-jet printer as well as a line ink-jet printer. A cut sheet can be used in the invention instead of the roll of sheet 6.

The curl correcting rollers 34, 35 are not necessarily provided to the sheet cassette 3, but can be provided to other portions. In this case, a curl correcting mechanism is preferably provided in the printer body 1*a*. The shape of the stopper 41 is not limited to that described in the embodiment of the invention. Any stopper that moves to the position for blocking the sheet conveying path when the sheet cassette 3 is attached to the printer body 1*a* can be used.

In the above-described embodiment, the printer 1 that the sheet cassette 3 can be attached thereto and detached therefrom is described. However, the invention can also be applied to a printer that directly houses a roll of paper without using a sheet cassette. Because the operating knob 48 is attached to the end of the shaft 49 of the correcting roller 34, the shaft 49 of the correcting roller 34 is directly rotated by turning the operating knob 48. However, the correcting roller 34 can be indirectly rotated via a gear.

A plurality of levers 40 for functioning as the stopper 41 may be provided. In the above-described embodiment, the levers 36, 40 are urged by the springs 37 and the coil spring 40. However, other means or devices can be adopted to urge the levers 36, 40.

What is claimed is:

1. A cassette capable of being attached to a body of an image forming apparatus, comprising:

a support portion that rotatably supports a roll in which a recording medium is wound;

a guide member that guides, along a recording medium conveying path, the recording medium drawn from the roll supported by the support portion; and a stopper that selectively protrudes from an opening in the guide member and that selectively locates at a blocking position where the stopper protrudes from the opening and blocks the recording medium conveying path and at an unblocking position where the stopper does not protrude from the opening and does not block the recording medium conveying path.

2. The cassette according to claim 1, wherein the stopper locates at the blocking position when the cassette is not attached to the body and locates at the unblocking position when the cassette is attached to the body.

3. The cassette according to claim 2, further comprising:

a first rotatable lever that is urged by a first elastic member so that one end of the first rotatable lever protrudes outside of the rolled recording medium cassette, wherein the stopper changes position in accordance with a rotation of the first rotatable lever, and the lever rotates to move the stopper to the unblocking position by which the one end contacts the body of the image forming apparatus when the cassette is attached to the body.

4. The cassette according to claim 3, wherein:

the cassette can be attached to the body while a first end face, that faces the body, of a portion included in a recording medium conveying path provided in the cassette is urged so as to rotate in a direction toward a second end face, that faces the cassette, of a portion included in the recording medium conveying path, about a position where the rolled recording medium is attached to the body of the image forming apparatus, and the one end of the first rotatable lever protrudes from a surface opposite to the first end face, with respect to an attaching position, when the cassette is not attached to the body, and the first end face is urged by the second end face about the position by a resilience of the elastic member generated by the rotation of the first end face due to the contact of the first rotatable lever with the body when the cassette is attached to the body.

5. The cassette according to claim 1, further comprising:

a curl correcting mechanism that is provided upstream of the stopper in a drawing direction of the recording medium in order to correct a curl.

6. The cassette according to claim 5, wherein the curl correcting mechanism includes a pair of rollers.

7. The cassette according to claim 6, wherein the pair of rollers are intimately contacted with each other when the cassette is not attached to the body, and are separated from each other when the cassette is attached to the body.

8. The cassette according to claim 7, further comprising:

a second rotatable lever that is urged by a second elastic member so that one end of the second lever protrudes outside of the cassette, wherein the pair of rollers change position in accordance with the rotation of the second lever, and the second lever rotates to change the position of the pair of rollers from a position where the pair of rollers contact each other to a position where the pair of rollers are separate from each other.

9. The cassette according to claim 8, wherein:

the cassette can be attached to the body while a first end face, that faces the body, of a portion included in a recording medium conveying path provided in the cassette is urged so as to rotate in a direction toward a second end face, facing the cassette, of a portion included in the recording medium conveying path, about a position where the rolled recording medium is attached to the body of the image forming apparatus, and the one end of the lever protrudes from a surface opposite to the first end face, with respect to an attaching position, when the cassette is not attached to the body, and the first end face is urged by the second end face about the position by a resilience of the elastic member generated by the rotation of the first end face due to the contact of the lever with the body when the cassette is attached to the body.

10. The cassette according to claim 8, wherein when the stopper is at the unblocking position, the pair of rollers are separate from each other.

11. The cassette according to claim 6, further comprising an operating knob for manually rotating the pair of rollers.

12. An image forming apparatus, comprising:

a support portion that rotatably supports a roll in which a recording medium is wound;

a guide member that guides, along a recording medium conveying path, the recording medium drawn from the roll supported by the support portion;

a stopper that selectively protrudes from an opening in the guide member and that selectively locates at a blocking position where the stopper protrudes from the opening and blocks the recording medium conveying path and at an unblocking position where the stopper does not protrude from the opening and does not block the recording medium conveying path;

a sheet supply mechanism that conveys the recording medium from an upstream side to a downstream side with respect to the stopper; and an image forming unit that forms an image onto the recording medium at a position downstream of the stopper.

13. A cassette capable of being attached to a body of an image forming apparatus, comprising:

a member that is capable of urging a first end face, that faces the body, of a portion included in a recording medium conveying path provided in the cassette so as to rotate in a direction toward a second end face, that faces the cassette, of a portion included in the recording medium conveying path provided in the body, about a position where the cassette is attached to the body of the image forming apparatus.

14. The cassette according to claim 13, comprising:

a lever that is urged by an elastic member and is rotatably supported, wherein the one end of the lever protrudes from a surface opposite to the first end face, with respect to an attaching position, when the cassette is not attached to the body, and the first end face is urged by the second end face about the position by a resilience of the elastic member generated by the rotation of the first end face due to the contact of the lever with the body when the cassette is attached to the body.

15. The cassette according to claim 14, wherein another end of the lever serves as a stopper for intermittently blocking the conveying path, the stopper located at a position to block the conveying path when the rolled recording medium cassette is not attached to the body, and the stopper located at a position not to block the conveying path when rolled recording medium cassette is attached to the body.

16. The cassette according to claim 14, wherein the another end of the lever serves as one of the pair of rollers capable of pinching the recording medium passing the conveying path, the pair of rollers are in contact with each other when the rolled recording medium cassette is not attached to the body, and the pair of rollers are separated from each other by the movement of the one end when rolled recording medium cassette is attached to the body.

17. The cassette according to claim 13, comprising:

a housing that houses a roll of the recording medium.

18. The cassette according to claim 13, comprising:

a projection that faces and engages the body of the image forming apparatus, wherein the projection is urged so as to rotate in a direction toward the second end face about the position where the projection of the cassette is engaged to the body of the image forming apparatus.

19. A cassette capable of being attached to a body of an image forming apparatus, comprising:

a support portion that rotatably supports a roll in which a recording medium is wound;

a guide member that guides, along a recording medium conveying path, the recording medium drawn from the roll supported by the support portion;

a curl correcting mechanism that is provided in a drawing direction of the recording medium in order to correct a curl, wherein the curl correcting mechanism includes a pair of rollers; and a lever that is urged by an elastic member so that one end of the lever protrudes outside of the cassette, wherein the pair of rollers change position in accordance with a rotation of the lever, and the lever rotates to change the position of the pair of rollers from a position where the pair of rollers contact each other to a position where the pair of rollers are separate from each other.

* * * * *